United States Patent [19]

Rausch et al.

[11] 4,242,420

[45] Dec. 30, 1980

[54] SELECTIVE CHROMIZING IN A MOLTEN LEAD MEDIUM

[75] Inventors: John J. Rausch, Rte. 2, Box 177, Antioch, Ill. 60002; Ray J. Van Thyne, 10148 S. Cook Ave., Oak Lawn, Ill. 60453

[73] Assignees: John J. Rausch; Ray J. Van Thyne; Material Sciences Corporation, all of Mt. Prospect, Ill.

[21] Appl. No.: 55,686

[22] Filed: Jul. 6, 1979

Related U.S. Application Data

[62] Division of Ser. No. 840,368, Oct. 7, 1977, Pat. No. 4,168,333.

[51] Int. Cl.[3] ..... C23C 9/00

[52] U.S. Cl. ..... 428/667; 427/431

[58] Field of Search ..... 427/431, 432, 433; 428/664

[56] References Cited

U.S. PATENT DOCUMENTS

| | | | |
|---|---|---|---|
| 3,184,331 | 5/1965 | Carter | 427/431 |
| 3,467,545 | 9/1969 | Carter | 427/431 |
| 3,620,816 | 11/1971 | Rausch et al. | 427/433 |

FOREIGN PATENT DOCUMENTS

| | | | |
|---|---|---|---|
| 878028 | 9/1961 | United Kingdom | 427/431 |

*Primary Examiner*—Ralph S. Kendall

*Attorney, Agent, or Firm*—Vogel, Dithmar, Stotland, Stratman & Levy

[57] ABSTRACT

A ferrous based substrate is diffusion coated by contacting the substrate with a molten alloy bath consisting essentially of lead and chromium, wherein the quantity of chromium is less than 0.85% of the weight of the lead.

2 Claims, 3 Drawing Figures

SELECTIVE CHROMIZING IN A MOLTEN LEAD MEDIUM

This is a division of application Ser. No. 840,368, filed Oct. 7, 1977, now U.S. Pat. No. 4,168,333.

BACKGROUND OF THE INVENTION

We are the named patentees in U.S. Pat. No. 3,628,816 which describes a process of diffusion alloying the surface of a ferrous part in a molten lead medium. In this process, chromium is dissolved into molten lead which is placed in contact with the ferrous part to be surfaced. Chromium is alloyed into the surface of the part by metallic diffusion. Our earlier work with chromizing of steel involved use of a relatively high chromium addition to insure a high chromizing potential. Solubility of chromium in molten lead is reported (*Constitution of Binary Alloys*—Hansen & Anderko—McGraw Hill, 1956) to be 0.05% by weight in lead at about 2,000° F., a typical processing temperature. The lead bath contained at least 2% elemental chromium or 2% ferrochromium (approximately 70% chromium, 30% iron) in all of the examples in our prior patent; in many of the examples the quantity of chromium exceeded 2%.

The process of surface alloying the ferrous part may be carried out in a sealed reactor containing the molten lead and the chromium. Because of the volatilization of lead at temperatures near 2,000° F., it is desirable to cool the reactor to a lower temperature, such as 800° F., but above the melting point of lead, before opening the reactor. During this cooling, the solubility of chromium in lead is reduced and undesirable precipitates form and deposit on the ferrous part being surfaced. The result of using these high chromium concentrations is undesirable surface roughness and porosity.

While there has been mention of substantial reduction of the percentage of chromium in the molten bath (for example, U.S. Pat., Nos. 3,184,331 and 3,467,545 and British Pat. No. 878,028), lead has not been the transfer vehicle in these processses. Instead, the processes disclosed in these patents employ totally different and unrelated baths, such as calcium, lithium and copper. Furthermore, these patents teach away from the use of chromium in the bath of sufficiently low percentage to arrive at the high quality surface mentioned above. For example, using calcium as a transfer bath in the process described in U.S. Pat. No. 3,184,331, it is therein stated that "while the content of transfer agent in the bath may vary between wide limits, a practical lower limit for most coating operations within the invention will be about 10% by weight". Likewise, in British Pat. No. 878.028, involving transfer of chromium in a molten copper bath, it is stated that 2–10% dissolved chromium is preferable.

A further undesirable aspect of maintaining high chromium content in the bath is the substantial cost. A high concentration in the bath results in a high concentration in the coating which reduces the ductility and malleability of the ferrous surface coated part.

It is therefore an important object of the present invention to provide a process for diffusing chromium into the surface of a ferrous part in a molten lead bath, in which the chromium content of the lead bath is reduced to a value that causes the resultant coating to be smoother and less porous.

Another object of the present invention is to provide an improved ferrous part made by this process.

Another object is to reduce the chromium content in the coating applied on a ferrous part by surface diffusion in molten lead bath to reduce cost of the process and to improve the ductility and malleability of surface diffused ferrous parts made by such process.

In summary, there is provided a process of diffusion coating a ferrous based substrate comprising: contacting the substrate with a molten lead-based bath containing lead and chromium as a surface diffusing element, the bath containing less than 0.85% chromium by bath weight, the lead-based bath having the essential physical and chemical properties of lead, and diffusing the chromium into the substrate.

A surface diffused part produced by such process comprises a ferrous based substrate and a zone at the surface of said substrate containing 5 to 45% chromium by weight.

The invention consists of certain novel features and a combination of steps and parts hereinafter fully described, and particularly pointed out in the appended claims, it being understood that various changes in the details may be made without departing from the spirit, or sacrificing any of the advantages of the invention.

DESCRIPTION OF THE PREFERRED EMBODIMENTS

A series of experiments were run in which the chromium addition made to the lead bath was varied. All experiments were carried out in 2 inch diameter steel tubes which were evacuated and sealed. Each tube contained about 2,100 grams of lead, chromium, and several samples. The samples used for analysis were decarburized 1006 steel and contained 0.0025% carbon (all compositions are in weight %). The ratio of the entire surface area of all the parts to the volume of lead in the bath is important and was held constant during these experiments.

We used granular vacuum grade elemental chromium having a mesh size of $+1/16-\frac{1}{8}$ in. and the following composition:

Cr—99.45%
C—0.041
Fe—0.35

The chromium and parts were in a lower chamber and held under the lead by a perforated washer having about 200, 3/64 in. diameter holes. During processing, the sealed tubes were shaken vigorously about every 10 minutes to minimize stagnation of the solutions. The sealed tubes were placed in a furnace at 2,000° F. and held at that temperature for 4 hours, after which they were removed and cooled in air. After cooling to about 800° F., the tubes were inverted to permit the lead to drain from the chamber containing the parts.

EXAMPLE 1

Figure 1:
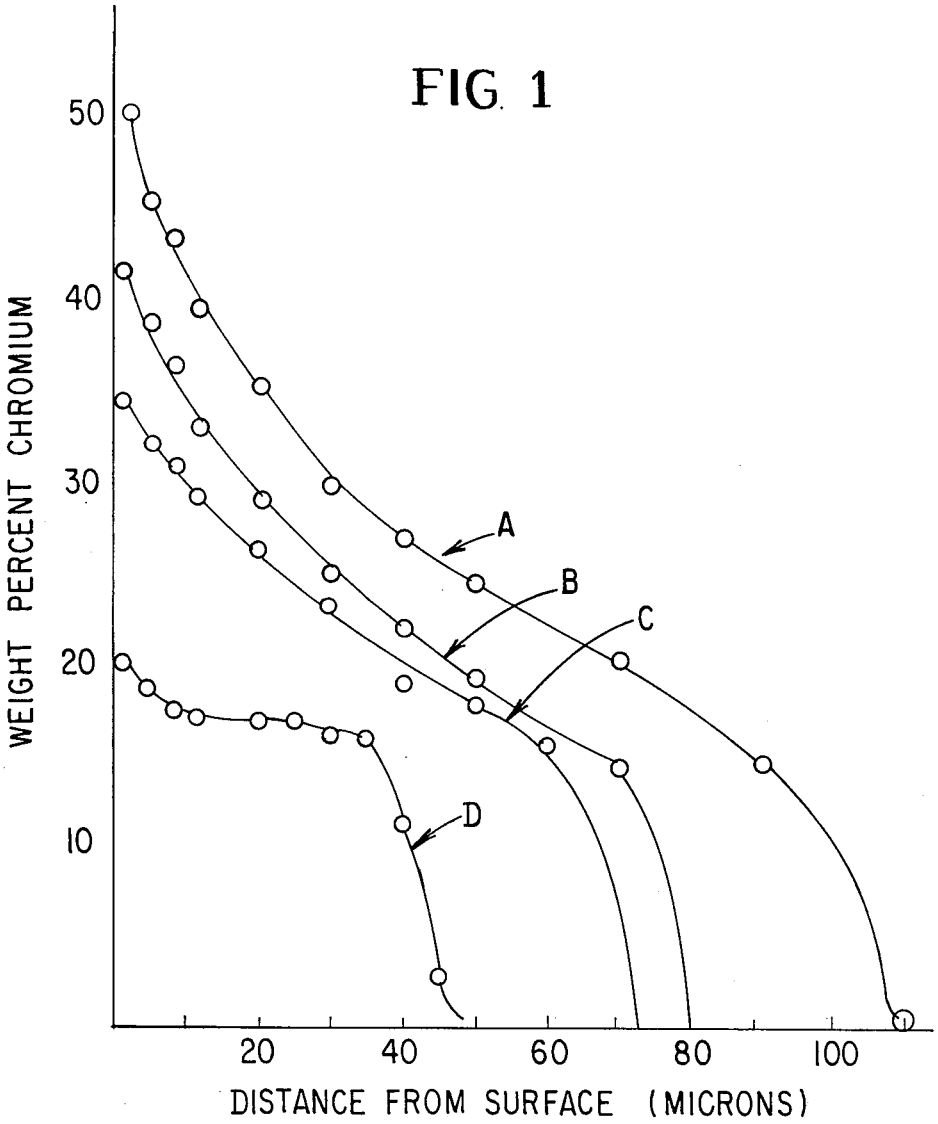
FIG. 1 is a graph in which weight percent chromium is plotted against distance from the surface, depicting the composition of the diffused coatings in various chromized ferrous parts.
Figure 2:
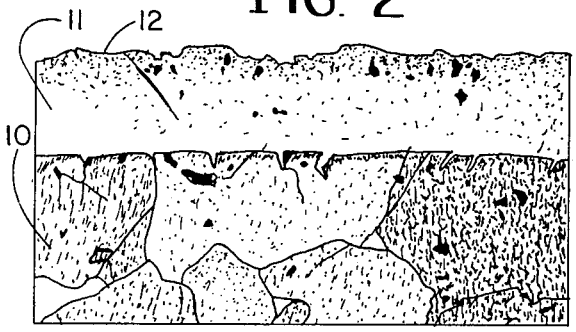
FIG. 2 is a photograph of the micro structure of a diffused coating formed at 2,000° F. after four hours in a bath containing 2,100 grams of lead and 25 grams of chromium (magnification: 200X)

Samples were run as described above in a tube containing 25 grams of chromium. A sample of the steel part was sectioned, polished, and etched with 5% Nital. A microprobe analysis was made of this cross section, the results of which are shown in FIG. 1—curve A. The chromium grades inwardly from a value of about 50% at the surface to 12% at a depth of about 100 microns from the surface. The microstructure of the sectioned part is shown in FIG. 2 and comprises a substrate 10 to which has been surface diffused chromium to provide a zone 11. Within two microns or so of the outer surface 12 of the zone 11, the chromium content by weight is about 50% as shown in curve A of FIG. 1. That curve further indicates that at depth of about 100 microns, the chromium content decreases to about 12%. The outer surface 12 of the chromized zone is quite irregular and considerable porosity exists in the chromized zone 11 near the surface 12. It should be noted that the irregularity and porosity is largely confined to the region of the chromized zone 11 where the chromium content is greater than 45%.

EXAMPLE 2

Figure 3:
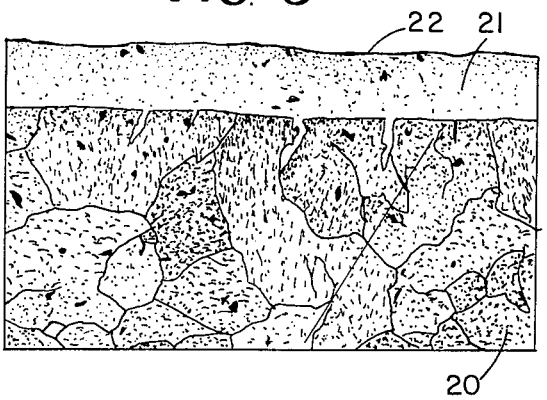
FIG. 3 is a photograph of the micro structure of a diffused coating formed at 2,000° F. after four hours in a bath containing 2,100 grams of lead and 10 grams of chromium (magnification: 200X).

Samples were run as described above in a tube containing 10 grams of chromium. The microstructure of the steel part is shown in FIG. 3, and includes a substrate 20 to which has been surface diffused chromium to provide a chromized zone 21 having an outer surface 22. It is to be understood that although there appear to be clear lines of demarcation in FIGS. 2 and 3 between the substrate and the chromized zone, in point of fact there is a continuum of chromium from the outer surfaces 11 and 21 as shown in the curves of FIG. 1. When the samples are etched, that portion having greater than a 12% chromium content is not affected; thus, the lines of demarcation.

It will be noted in FIG. 3 that the chromized zone 21 has a much smoother outer surface 22 with essentially no porosity. A microprobe analysis of this cross section is shown in curve B of FIG. 1. The chromium grades inwardly from a value of about 42% at the surface to a value of 12% at a depth of about 75 microns from the surface.

EXAMPLE 3

Samples were run as described above in a tube containing 5 grams of chromium. The microstructure of the steel part was similar to FIG. 3. The outer region of the chromized zone was rather smooth and showed no evidence of the porosity observed in example 1. A microprobe analysis of the cross section; FIG. 1—curve C, shows that the chromium grades inwardly from a value of about 35% at the surface to a value of 12% at a depth of about 70 microns.

EXAMPLE 4

Samples were run as described above in a tube containing 2 grams of chromium. The microstructures formed under these conditions again show the outer surface region of the chromized zone to be quite uniform and free of gross porosity. A microprobe analysis, FIG. 1-Curve D, shows the surface composition to be 20% Cr, grading inwardly to a value of 12% Cr at a depth of about 40 microns from the surface.

Example 1 shows that a ratio of 25 gms of chromium in a 2,100 gm lead bath (1.19%) results in the formation on an uneven chromized zone having excessive porosity. In example 2 where this ratio is 0.48% a very desirable smooth chromized surface free of gross porosity is formed. In example 3, the bath contained 0.24% chromium by weight and in example 4, the bath contained 0.09% chromium by weight. The samples corresponding to examples 3 and 4 also had improved smoothness and less porosity. Thus, these desired effects occur when the percentage of chromium in the molten lead bath is between 1.19 and 0.48. A percentage of 0.85, a value near the arithmetic mean, is the ideal value. In addition to providing more desirable surface characteristics by operating at values of this chromium-to-lead ratio and below, the ratio may be varied to control surface composition and layer thickness to produce desirable results.

When chromium alone is diffused into iron a minimum of 12% is required at the surface to achieve desired corrosion resistance. Our results have shown that the surface chromium content is limited to 45% to achieve desired surface characteristics. The presence of other elements in the surface layer, derived by coalloying or present in the substrate initially, can further improve the properties of the chromized layers produced. The presence of certain other elements (such as cobalt, nickel, aluminum, yttrium and rare earth metals, molybdenum, titanium, columbium, vanadium, tantalum, tungsten, silicon and manganese) can further result in developing useful properties with surface chromium levels as low as 5%.

We have found that the chromium content and diffusion depth may be controlled to give lower alloy levels in the diffusion zone while adding amounts that would be expected to readily saturate the lead to a level of 0.05% chromium. This was a surprising result, since it was expected that adding additional amounts of chromium to the bath above that amount expected to saturate the bath would have no effect.

In this application we refer to a lead-based bath which has the essential physical and chemical properties of lead. By that we mean a lead-based bath, which although having diluent(s) therein, behaves essentially like a bath of lead alone.

It is understood that although certain examples have been set forth, various modifications and variations may be made without departing from the spirit or scope of the invention.

We claim:

1. A surface-diffused part comprising a ferrous-based substrate and a zone at the surface of said substrate containing 12 to 45% chromium by weight, said zone having an outer surface which is substantially smooth and is free of gross porosity, said part being made by the process of providing a ferrous-based substrate and contacting said substrate with a molten alloy bath consisting essentially of lead and chromium as a surface-diffusing element, lead being the only transfer agent in said bath, said bath containing less than 0.85% chromium by bath weight of said lead, and diffusing said chromium into said substrate.

2. The part of claim 1, wherein it is made in a bath containing chromium as the only surface diffusing element.

* * * * *